US006148807A

United States Patent [19]

Hazen

[11] Patent Number: 6,148,807

[45] Date of Patent: Nov. 21, 2000

[54] CRANKCASE FLUID PROCESSING SYSTEM FOR AUTOMOTIVE ENGINE

[75] Inventor: David James Hazen, Ann Arbor, Mich.

[73] Assignee: Ford Global Technologies, Inc., Dearborn, Mich.

[21] Appl. No.: 09/336,576

[22] Filed: Jun. 21, 1999

[51] Int. Cl.[7] ..... F01M 13/00

[52] U.S. Cl. ..... 123/572

[58] Field of Search ..... 123/196 R, 195 C, 123/572, 573, 574, 196 CP

[56] References Cited

U.S. PATENT DOCUMENTS

| | | | |
|---|---|---|---|
| 3,754,538 | 8/1973 | Ephraim, Jr. et al. | 123/41.86 |
| 3,839,996 | 10/1974 | DeBiasse | 123/195 |
| 4,269,607 | 5/1981 | Walker | 123/573 |
| 4,528,969 | 7/1985 | Senga | 123/572 |
| 4,681,068 | 7/1987 | Anno et al. | 123/573 |
| 4,721,090 | 1/1988 | Kato | 123/572 |
| 4,846,307 | 7/1989 | Kinouchi et al. | 123/196 CP |
| 5,027,784 | 7/1991 | Osawa et al. | 123/572 |
| 5,474,035 | 12/1995 | Ming et al. | 123/41.86 |
| 5,570,662 | 11/1996 | Niemchick et al. | 123/196 CP |

*Primary Examiner*—Willis R. Wolfe
*Assistant Examiner*—Hyder Ali
*Attorney, Agent, or Firm*—Jerome R. Drouillard

[57] ABSTRACT

A crankcase fluid processing system for a reciprocating automotive internal combustion engine includes a fluid collector pan for closing the lower ends of the cylinder block into separate bays and an evacuation valve for each of the bays, with the valves serving to allow fluid in the collector compartments to be expelled whenever the pistons in the bay move from top dead center to bottom dead center. As a result, the power output and fuel economy of the engine may be improved.

4 Claims, 1 Drawing Sheet

CRANKCASE FLUID PROCESSING SYSTEM FOR AUTOMOTIVE ENGINE

BACKGROUND OF THE INVENTION

1. Field of the Invention

The present invention pertains to a system for handling fluids including air, fuel vapor, blow-by gas, and oil within the crankcase of an internal combustion engine.

2. Discussion of Prior Art

Automotive internal combustion engines typically utilize an oil pan for the purpose of closing the bottom end of the engine's cylinder block. Because a quantity of oil is required to lubricate the engine while keeping the oil at a reasonable temperature, it is usually necessary to provide the oil pan with a built-in reservoir. This has a drawback inasmuch as such a reservoir limits the ability of the engine to be mounted low within a vehicle, thereby increasing the package height of the engine undesirably, particularly with newer vehicles having lowered hood lines. Although it is possible and known to provide an engine with a dry sump system, and although this is commonly done with racing engines, known dry sump systems are prohibitively expensive for production vehicles because they require multi-stage pumps which must be driven by the engine's crankshaft merely for the purpose of picking up oil from the oil pan and providing it to a surge tank.

A system according to the present invention solves the problem of reducing engine package height by providing a compact fluid collector pan, while allowing the engine's oil reservoir to be mounted elsewhere in the vehicle and while further allowing superior separation of blow-by and oil from the engine's crankcase gases.

Another advantage resulting from the present invention is that at high speeds, engine performance is degraded by the presence of oil vapor about the crankshaft, i.e., so-called windage. The phenomenon of windage occurs when the engine's crankshaft spins at very high speeds, say in excess of 5000 rpm; this may cause oil within the crankcase and oil pan to be whipped into a froth which physically impedes passage of the spinning crankshaft, thereby reducing the engine's power output. A system according to the present invention prevents this situation by evacuating oil and all other fluids from the engine crankcase, thereby allowing the crankshaft to turn substantially unimpeded by windage no matter what the engine speed.

SUMMARY OF THE INVENTION

A crankcase fluid processing system for a reciprocating automotive internal combustion engine having a plurality of pistons and a crankshaft housed within a cylinder block divided into bays defined by main bearing bulkheads includes a fluid processing system with a fluid collector pan for sealingly closing the lower ends of the crankcase bays so as to define a separate, isolated fluid collector compartment for each bay. A plurality of evacuation valves is provided with at least one of such valves being associated with each of said fluid collector compartments, with said valves serving to allow fluid collected in said compartments to be expelled from the collector compartments in response to movement of the pistons in the direction from bottom dead center. The evacuation valves further serve to prevent air from entering the bays when the pistons move to the top dead center position. This allows the crankcase to operate at subatmospheric pressure during at least a portion of the ascension of the piston.

According to another aspect of the present invention, a fluid processing system for an internal combustion engine includes a separator for receiving fluid expelled from the fluid collector compartments and for separating the fluid into liquid, gas and vapor. The liquid oil is returned to an engine's oil supply system, and the gas and vapor is provided to a combustion air inlet.

Each of the evacuation valves may comprise an outward opening check valve which opens in response to an increase of gas or fluid pressure within a bay. Each of the exact evacuation valves closes sufficiently when an associated piston moves to its top dead center position such that the total pressure of air, gas and vapor within the fluid collector compartment becomes subatmospheric.

According to the present invention, an engine equipped with the present system may preferably comprise either a four-stroke cycle engine or a two-stroke cycle engine. In any event, fluid collected in the fluid collector compartments will be expelled from the collector compartments in response to air pushed by movement of the engine's pistons in the direction of bottom dead center with the evacuation valves preventing air from entering the bays when each piston moves to its top dead center position.

According to another aspect of the present invention, a method for processing crankcase fluid within a multicylinder reciprocating internal combustion engine having a cylinder block with a plurality of main bearing bulkheads, a crankshaft, pistons mounted within the cylinders to the crankshaft and moving between top dead center and bottom dead center, includes the steps of: establishing a plurality of sealed fluid collector compartments having a number not less than approximately the number of connecting rod journals of the engine's crankshaft, with the fluid collector compartments serving to close the bottom end of the cylinder block in the manner of an oil pan, while also sealing individually to the main bearing bulkheads.

Additional steps of the present method include providing a plurality of normally closed check valves with at least one check valve extending through a lower region of each of the fluid collector compartments, and permitting the check valves to individually open in response to a build-up of fluid pressure within the fluid collector compartments such that fluid within each of the fluid collector compartments will be expelled by air compressed within the fluid collector compartments by the pistons. The gas pressure within a particular collector compartment is allowed to alternate between a greater pressure when a piston associated with a particular compartment is moving from top dead center to bottom dead center and a lower pressure when the piston is moving from bottom dead center to top dead center.

DETAILED DESCRIPTION OF PREFERRED EMBODIMENT(S)

Figure 1:
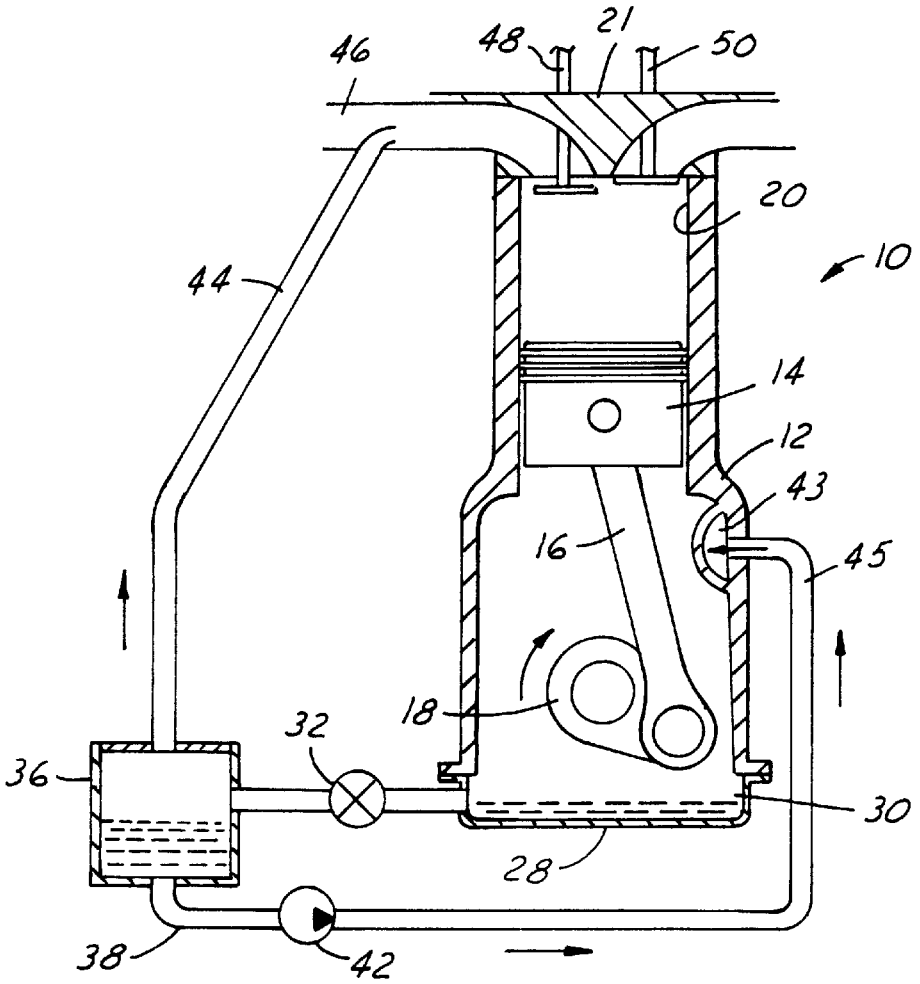
FIG. 1 is schematic representation of an engine having a crankcase fluid processing system according to the present invention.
Figure 2:
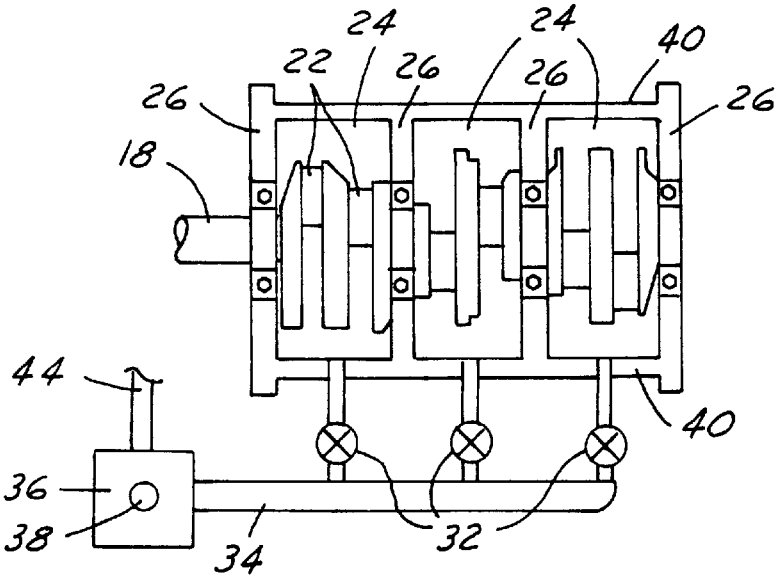
FIG. 2 is a plan view, partially broken away, of a lower portion of an engine according to FIG. 1.

As shown in FIG. 1, engine 10 having cylinder block 12 has a piston 14 connected with crankshaft 18 by means of connecting rod 16. Piston 14 is reciprocably housed within cylinder 20. Cylinder head 21 closes the upper end of cylinder 20. As shown in FIG. 2, a plurality of pistons is mounted upon crankshaft 18 by means of a plurality of connecting rods 16 (not shown). As is further shown in FIG. 2, a plurality of main bearing bulkheads 26 divides the lower portion of cylinder block 12 into a plurality of bays 24.

Each of bays 24 is sealingly closed by means of fluid collector pan 28 which defines a plurality of fluid collection compartments 30. Multiple fluid collection compartments are defined because fluid collector pan 28 sealingly joins with each of main bearing bulkheads 26 and both oil pan rails 40 (FIG. 2). In essence, fluid collector pan 28 forms a plurality of individually sealed oil pans at the bottom extent of engine 10. In a departure from past practice with respect to oil pans, however, oil is only accumulated during part of each cycle of the engine, because as pistons 40 descend in cylinders 20, moving from top dead center to bottom dead center, evacuation valves 32 allow accumulated fluid, consisting of oil, blow-by gases, oil vapor, fuel, and any mixture of these substances, to be expelled from collection compartments 30 and pushed into separator 36. In essence, evacuation valves 32 comprise one-way valves, which may be one-way check valves or even electronically controlled valves operated by an engine controller. In such a manner, valves 32 can be used to maintain a depression within bays 24 at a desired level. It has been determined that an appropriate pressure within the crankcase is about one-half atmospheric pressure with piston 14 on their upstroke.

Fluid discharged through evacuation valves 32 moves into a manifold 34 and then into separator 36. Separator 36, having received fluid expelled from fluid collection compartments 30, separates the fluid into liquid, gas and vapor. The liquid oil is returned via fluid discharge line 38 to oil pump 42 and then by means of discharge line 45 to oil gallery 43, which is part of the engine's lubrication system. Gas and vapor are discharged from separator 36 into gas and vapor discharge line 44 and returned to engine intake 46 for use within cylinder 20. Of course, the gas and vapor are first passed through intake valve 48.

As noted above, evacuation valves 32 are sized such that as pistons 14 move to their top dead center position the total pressure of fluid within the fluid collection compartments comes subatmospheric, preferably about one-half bar.

According to another aspect of the present invention, a method for processing crankcase fluid within a multicylinder reciprocating internal combustion engine includes the steps of establishing a plurality of sealed fluid collector compartments having a number equal to at least approximately the number of connecting rod journals of the engine's crankshaft and using such fluid collection compartments to close the bottom end of the cylinder block by sealing individually to the main bearing bulkheads and oil pan rails.

Another aspect of the present method includes providing a plurality of normally closed check valves 32 and permitting the check valves to individually open in response to the build-up of fluid pressure within the fluid collection compartments such that the fluid within the collection compartments will be expelled by air compressed within the fluid collector compartments by the pistons. As used herein, the term "air" also includes fluids comprising blow-by vapors and oil in air, fuel vapor, or any combination thereof.

Those skilled in the art will appreciate in view of this disclosure that separator 36 could be mounted above the level of engine 10 or below it or any other position so as to allow maximum package flexibility. Those skilled in the art will further appreciate in view of this disclosure that a method and system according to the present invention could be employed with either two or four stroke engines, it being understood that the benefit of the oscillating pressure within the crankcase going from a higher pressure when the piston is descending from top dead center to bottom dead center to a lower pressure when the piston is ascending from bottom dead center to top dead center position will produce the corresponding benefits in terms of power output and fuel economy increase.

While the invention has been shown and described in its preferred embodiments, it will be clear to those skilled in the arts to which it pertains that many changes and modifications may be made thereto without departing from the scope of the invention.

What is claimed is:

1. A crankcase fluid processing system for a four stroke cycle reciprocating automotive internal combustion engine having a plurality of pistons and a crankshaft housed within a cylinder block divided into bays defined by main bearing bulkheads, with said fluid processing system comprising:

a fluid collector pan for sealingly closing lower ends of said bays, so as to define a separate, isolated fluid collection compartment for each bay;

a plurality of evacuation valves, with at least one of said valves being associated with each of said fluid collection compartments, with said valves serving to allow fluid collected in said compartments to be expelled from the collection compartments in response to movement of the pistons in the direction of bottom dead center, with said evacuation valves further serving to prevent air from entering the bays when the pistons move to the top dead center position.

2. A fluid processing system according to claim 1, further comprising a separator for: receiving fluid expelled from said fluid collection compartments; separating the fluid into liquid, gas, and vapor; returning the liquid to an engine oil supply system; and providing the gas and vapor to a combustion air inlet.

3. A fluid processing system according to claim 2, wherein said engine oil supply system comprises an engine oil pump for receiving liquid from the separator and for supplying the liquid to a lubrication system associated with the engine.

4. A fluid processing system according to claim 1, wherein each of said evacuation valves comprises an outward opening check valve which opens in response to an increase of fluid pressure within a bay.

* * * * *